US008925278B2

(12) United States Patent
Sugihara et al.

(10) Patent No.: US 8,925,278 B2
(45) Date of Patent: Jan. 6, 2015

(54) CONNECTING FITTING, BEARING WALL PROVIDED WITH SAME, AND BUILDING USING SAME

(75) Inventors: Masami Sugihara, Osaka (JP); Hitomi Sunagawa, Osaka (JP); Tomoya Hatae, Osaka (JP); Masayuki Ogawa, Osaka (JP); Hiroaki Kawakami, Tokyo (JP); Kazunori Fujihashi, Tokyo (JP)

(73) Assignees: Sekisui House, Ltd., Osaka-Shi (JP); Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 14/001,035

(22) PCT Filed: Feb. 8, 2012

(86) PCT No.: PCT/JP2012/000817
§ 371 (c)(1),
(2), (4) Date: Aug. 22, 2013

(87) PCT Pub. No.: WO2012/114665

PCT Pub. Date: Aug. 30, 2012

(65) Prior Publication Data

US 2013/0326978 A1 Dec. 12, 2013

(30) Foreign Application Priority Data

Feb. 23, 2011 (JP) ..... 2011-037442
Feb. 23, 2011 (JP) ..... 2011-037443

(51) Int. Cl.

| | |
|---|---|
| ***E04B 1/58*** | (2006.01) |
| ***E04B 2/56*** | (2006.01) |
| ***E04B 1/08*** | (2006.01) |
| *E04B 1/24* | (2006.01) |

(52) U.S. Cl.
CPC ... *E04B 1/58* (2013.01); *E04B 2/56* (2013.01); *E04B 1/08* (2013.01); *E04B 2001/2496* (2013.01)
USPC ..... 52/657; 52/695; 52/167.3; 52/656.9

(58) Field of Classification Search
CPC ..... E04B 2001/2496; E04B 2001/2145; E04B 2001/2463; E04B 2001/2448
USPC ..... 52/167.3, 274, 293.3, 655.1, 656.9, 52/657, 693, 695; 403/170, 174, 217, 382, 403/403
See application file for complete search history.

(56) References Cited

U.S. PATENT DOCUMENTS 5,937,607 A * 8/1999 Li ..... 52/656.1
6,389,778 B1 * 5/2002 Strange ..... 52/745.19

(Continued)

FOREIGN PATENT DOCUMENTS

JP 60-133012 U 9/1985
JP 9-302814 * 11/1997

(Continued)

OTHER PUBLICATIONS

International Search Report issued in PCT/JP2012/000817 mailed on May 22, 2012.

*Primary Examiner* — Robert Canfield
(74) *Attorney, Agent, or Firm* — Birch, Stewart, Kolasch & Birch, LLP

(57) ABSTRACT

A connecting fitting includes a vertical frame attachment section 15*a* that can be attached to an inner surface of a vertical web 7*a* of a vertical frame 7A, 7B by way of bolts B2 in a state where the vertical frame attachment section 15*a* is disposed along the vertical web 7*a*, a brace attachment plate 14, connected to the vertical frame attachment section 15*a*, which enables attachment of an end of a brace 10A, 10B at a position inward of the vertical frame 7A, 7B, and a fixing plate 11, welded to the vertical frame attachment section 15*a*, which can be fixed to a beam member 4 or a foundation 2 in a state where the fixing plate 11 is disposed along an outer surface of a lateral frame 8A, 8B facing outward in a state of being disposed to make up a frame shape.

15 Claims, 11 Drawing Sheets

(56) References Cited

U.S. PATENT DOCUMENTS

| | | | | |
|---|---|---|---|---|
| 6,719,481 | B2 * | 4/2004 | Hoffmann | 403/403 |
| 6,920,724 | B1 * | 7/2005 | Hundley | 52/167.3 |
| 6,941,718 | B1 * | 9/2005 | diGirolamo et al. | 52/695 |
| 7,299,596 | B2 * | 11/2007 | Hildreth | 52/695 |
| 7,703,244 | B2 * | 4/2010 | Suzuki et al. | 52/167.3 |
| 7,784,226 | B2 * | 8/2010 | Ichikawa et al. | 52/167.1 |
| 8,505,260 | B1 * | 8/2013 | Chang et al. | 52/704 |
| 2004/0211140 | A1 * | 10/2004 | Suzuki et al. | 52/393 |
| 2005/0005561 | A1 * | 1/2005 | Hanson | 52/633 |
| 2005/0229509 | A1 * | 10/2005 | Majlessi | 52/167.3 |
| 2007/0245643 | A1 * | 10/2007 | Ichikawa et al. | 52/167.3 |
| 2007/0289230 | A1 * | 12/2007 | Schroeder et al. | 52/149 |
| 2008/0066418 | A1 * | 3/2008 | Hildreth | 52/695 |
| 2011/0131896 | A1 * | 6/2011 | Hansen | 52/167.3 |
| 2013/0074440 | A1 * | 3/2013 | Black et al. | 52/704 |

FOREIGN PATENT DOCUMENTS

| | | | |
|---|---|---|---|
| JP | 3431755 | B2 | 7/2003 |
| JP | 2007-262658 | A | 10/2007 |
| JP | 2010-7454 | * | 1/2010 |

* cited by examiner

CONNECTING FITTING, BEARING WALL PROVIDED WITH SAME, AND BUILDING USING SAME

TECHNICAL FIELD

The present invention relates to a bearing wall that is used in buildings.

BACKGROUND ART

Buildings including a foundation, beam members that extend in the lateral-direction, and bearing walls that are fixed to the foundation or beam members, are conventionally known.

For instance, Patent Document 1 discloses a bearing wall such as the below-described one. The bearing wall disclosed in Patent Document 1 includes: a pair of vertical structural members and a pair of lateral structural members, disposed to make up a frame shape; four connecting fittings that connect end sections of the vertical structural members and end sections of the lateral structural members; and two braces spanning across the pairs of connecting fittings disposed along the diagonals of the frame shape.

The vertical structural members and lateral structural members are respectively channel steels having a web and a pair of flanges. The connecting fittings are gate-type members having a pair of mutually opposing side pieces, and an intermediate section that connects the bases of the side pieces. A fixing plate for fixing the brace is fixed to the side pieces of each connecting fitting, in a state where the fixing plate straddles the side pieces.

The flanges of each vertical structural member are fixed to respective side pieces in a state where the vertical structural member is disposed between the side pieces of the connecting fitting. Similarly, the flanges of each lateral structural member are fixed to respective side pieces in a state where the lateral structural member is disposed between the side pieces of the connecting fitting.

In the bearing wall disclosed in Patent Document 1, however, the side pieces of the connecting fittings are fixed to the flanges of the vertical structural members and the lateral structural members. Accordingly, the vertical structural members and the lateral structural members may deform on account of the tensile force generated in the braces. Specifically, a lateral-direction component in the tensile force generated in the braces is transmitted directly, in the form of a shear force, to the flanges of the vertical structural members. Meanwhile, a vertical-direction component in the tensile force generated in the braces is transmitted directly, in the form of a shear force, to the flanges of the lateral structural members. In the bearing wall disclosed in Patent Document 1, therefore, the flanges of the vertical structural members and the lateral structural members may deform on account of the tensile force generated in the braces.

Patent Document 1: Japanese Utility Model Application Publication No. S60-133012

SUMMARY OF THE INVENTION

It is an object of the present invention to provide a connecting fitting that can suppress deformation of a frame on account of a tensile force inputted from a brace, to provide a bearing wall provided with the connecting fitting, and to provide a building provided with the bearing wall.

In order to solve the above problems, the present invention provides a connecting fitting used for forming a bearing wall which includes a pair of vertical frames and a pair of lateral frames disposed to make up a frame shape and braces that support forces generated in the vertical frames and the lateral frames, and which is fixed to at least one of a foundation and a beam member of a building, the connecting fitting being capable of connecting an end section of each vertical frame and an end section of each lateral frame, and including: a vertical frame attachment section that can be attached to an inner surface of the vertical frame, by way of a threaded member, in a state where the vertical frame attachment section is disposed along the inner surface of the vertical frame facing inward in a state of being disposed to make up a frame shape; a brace attachment section, connected to the vertical frame attachment section, which enables attachment of an end of the brace at a position inward of the vertical frame attachment section; and a fixing plate, welded to the vertical frame attachment section, which can be fixed to the beam member or the foundation in a state where the fixing plate is disposed along an outer surface of the lateral frame facing outward in a state of being disposed to make up a frame shape.

The present invention provides also a bearing wall that is fixed to at least one of a foundation and a beam member of a building, the bearing wall including: a pair of vertical frames and a pair of lateral frames disposed to make up a frame shape; four connecting fittings capable of connecting end sections of the vertical frames and end sections of the lateral frames; and two braces each provided between two connecting fittings which are disposed in a diagonal of the frame shape among the four connecting fittings, the braces supporting forces generated in the vertical frames and the lateral frames, wherein the four connecting fittings are the above connecting fitting.

Further, the present invention provides a building that includes a foundation; a beam member; and the above bearing wall, fixed to at least one of the foundation and the beam member.

According to the present invention, deformation of frames caused by the tensile force inputted from braces can be suppressed.

MODE FOR CARRYING OUT THE INVENTION

Hereinafter, embodiments of the present invention are explained with reference to accompanying drawings. The embodiments described below are examples of concrete embodiment of the present invention, and are not intended to limit the technical scope of the present invention.

Figure 1:
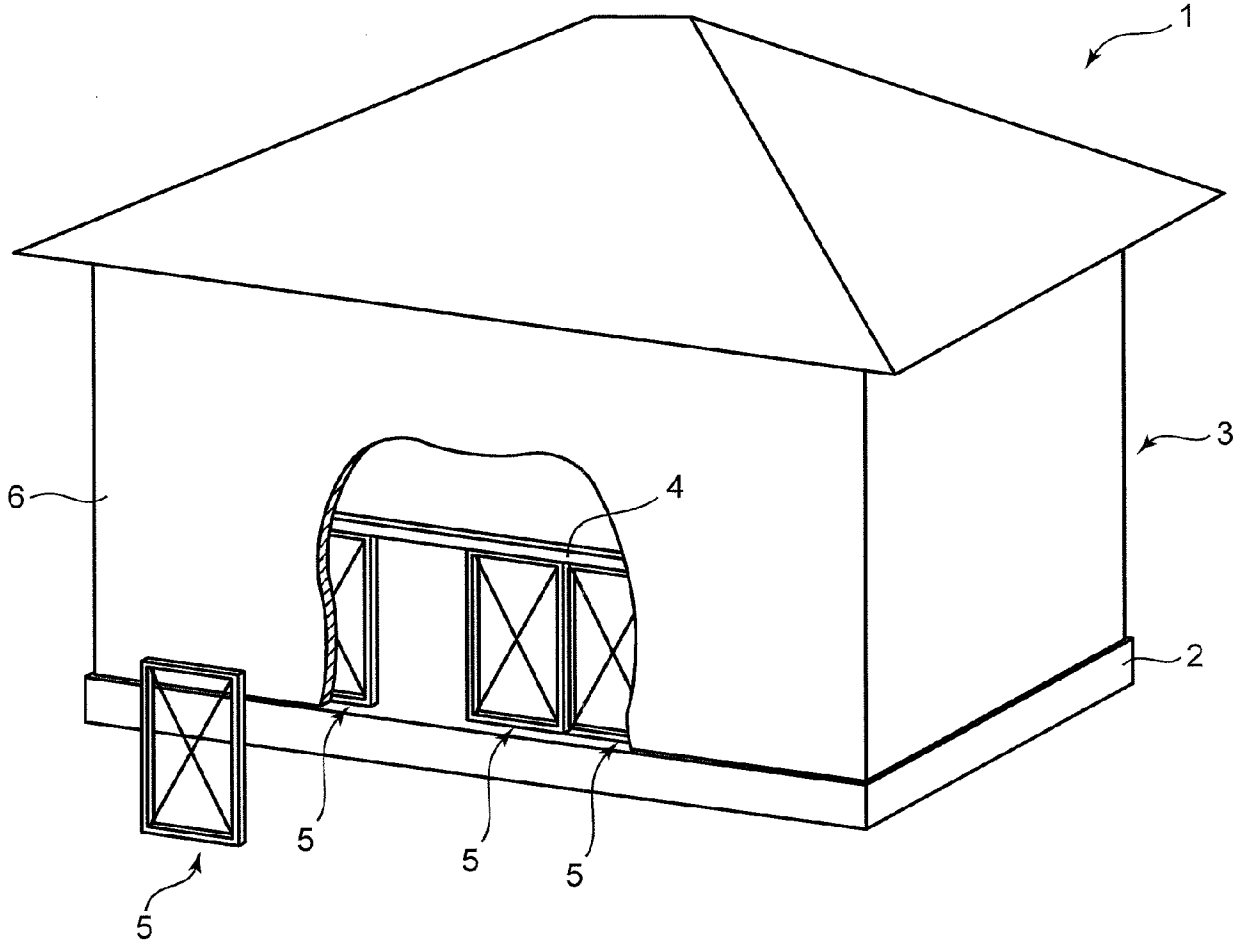
FIG. 1 is a perspective view illustrating a house according to an embodiment of the present invention.

FIG. 1 is a perspective view illustrating a house as an example of a building according to an embodiment of the present invention. A house 1 comprises a foundation 2 and a house body 3 provided on the foundation 2.

The house body 3 has a beam member 4 that extends in the lateral-direction, a plurality of bearing walls 5 provided between the beam member 4 and the foundation 2, and an outer wall 6 provided outward of the beam member 4 and the bearing walls 5.

Although not shown in FIG. 1, the house body 3 has a plurality of beam members 4. Specifically, a plurality of the beam member 4 are provided in the vertical direction according to the number of floors equal to or greater than two, and are also provided in one floor in the lateral-direction.

The bearing walls 5 provided between the foundation 2 and the beam members 4 are illustrated in FIG. 1, but the location at which the bearing walls 5 are provided is not limited to that depicted in the figure. Specifically, the house body 3 has bearing walls 5 provided between two beam members 4 that are arranged in the vertical direction, and bearing walls 5 provided between two beam members 4 that are arranged in the lateral-direction.

Figure 2:
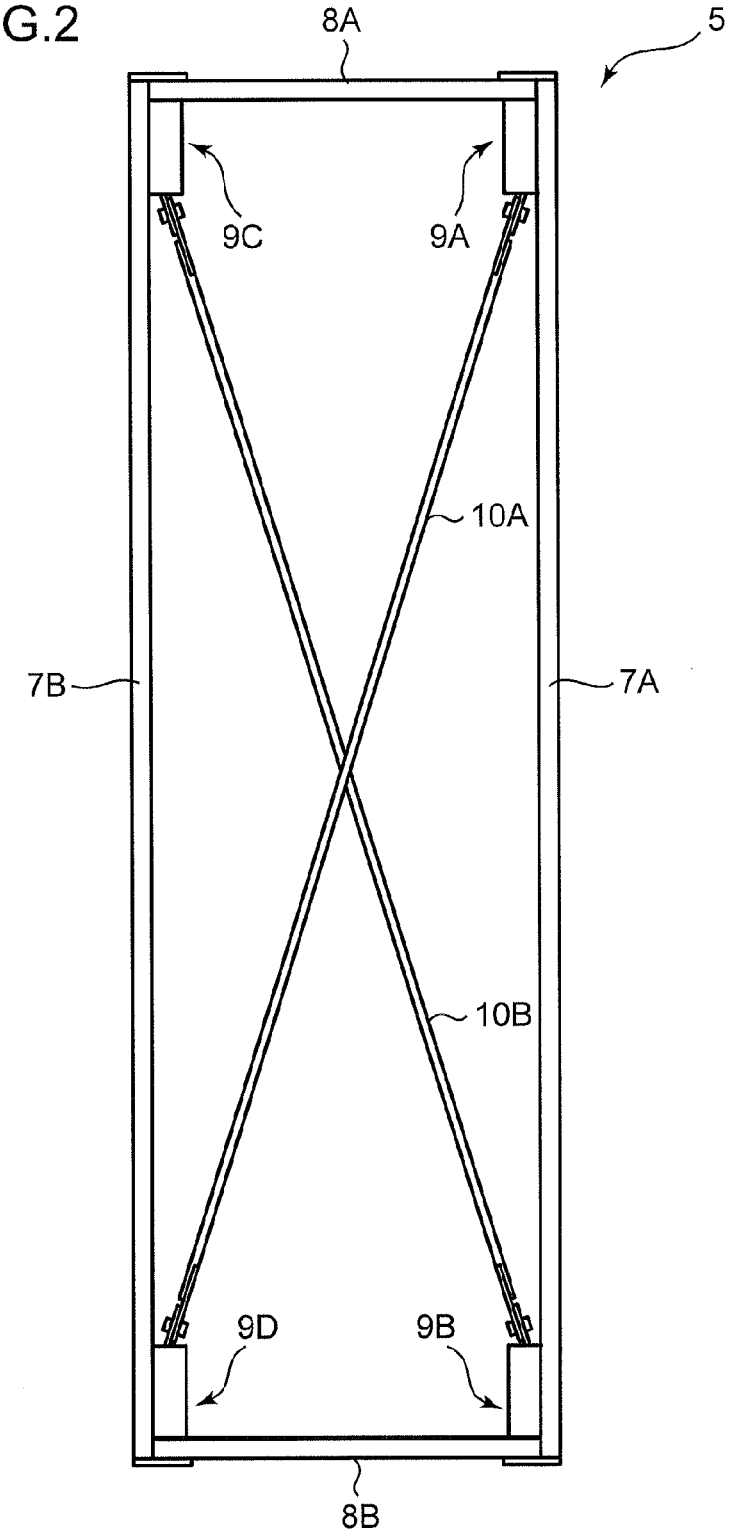
FIG. 2 is a front view of a bearing wall that is used in the house of FIG. 1.

FIG. 2 is a front view illustrating a bearing wall that is used in the house of FIG. 1.

As described above, the bearing walls 5 are fixed to at least one of the foundation 2 and the beam members 4. Specifically, the bearing walls 5 comprise a pair of vertical frames 7A, 7B and a pair of lateral frames 8A, 8B disposed to make up a frame shape, four connecting fittings 9A to 9D connectable end sections of the vertical frames 7A, 7B and end sections of the lateral frames 8A, 8B, and two braces 10A, 10B supporting forces generated in the frames 7A, 7B, 8A, 8B. In the explanation below, the direction facing inward of the frame formed by the frames 7A, 7B, 8A, 8B will be referred to as inward direction, and the direction facing outward of the frame will be referred to as the outward direction.

Figure 3:
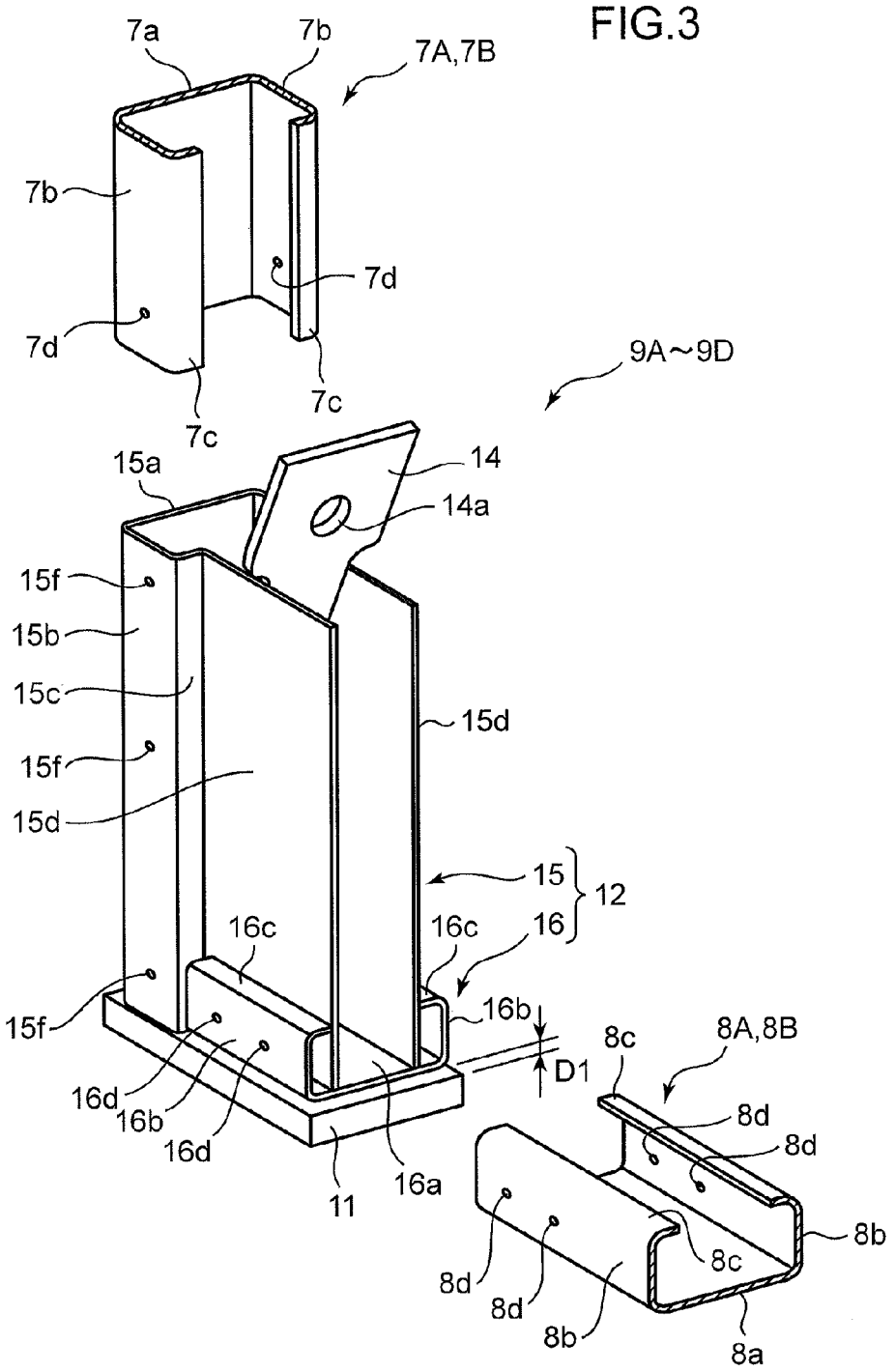
FIG. 3 is a perspective view illustrating an enlargement of a connecting fitting of the bearing wall of FIG. 2.

FIG. 3 is a perspective view illustrating an enlargement of a connecting fitting of the bearing wall of FIG. 2.

The vertical frames 7A, 7B are C-section steel formed by a steel material having a thickness of 2.3 mm. Specifically, the vertical frames 7A, 7B comprise a vertical web 7*a*, a pair of vertical flanges 7*b* folded inward from both edges of the vertical web 7*a*, a pair of vertical lips 7*c* folded from respective leading ends of the vertical flanges 7*b* in a direction of coming close to each other, a plurality of through-holes (one in FIG. 3) 7*d* penetrating through the respective vertical flanges 7*b*, and two through-holes (see FIG. 4) 7*e* penetrating through the vertical web 7*a*.

The lateral frames 8A, 8B are C-section steel formed by a steel material having a thickness of 2.3 mm. The lateral frames 8A, 8B have a cross-sectional shape identical to that of the vertical frames 7A, 7B. Specifically, the lateral frames 8A, 8B have a lateral web 8*a*, a pair of lateral flanges 8*b* folded inward from both edges of the lateral web 8*a*, a pair of lateral lips 8*c* folded from respective leading ends of the lateral flanges 8*b* in a direction of coming close to each other, and two through-holes 8*d* penetrating through the lateral flanges 8*b*.

With reference to FIG. 2, the connecting fitting 9A connects an end section of the vertical frame 7A with an end section of the lateral frame 8A. The connecting fitting 9B connects an end section of the vertical frame 7A with an end section of the lateral frame 8B. The connecting fitting 9C connects an end section of the vertical frame 7B with an end section of the lateral frame 8A. The connecting fitting 9D connects an end section of the vertical frame 7B with an end section of the lateral frame 8B. The connecting fittings 9A, 9C can be fixed to the foundation 2 or a beam member 4 disposed along the outer surface of the lateral frames 8A. The connecting fittings 9B, 9D can be fixed to the foundation 2 or a beam member 4 disposed along the outer surface of the lateral frames 8B. The brace 10A is provided between the connecting fitting 9A and the connecting fitting 9D. The brace 10B is provided between the connecting fitting 9B and the connecting fitting 9C. The connecting fittings 9A to 9D have the same configuration.

With reference to FIG. 3, the connecting fittings 9A to 9D have an attachment member 12 for attaching the vertical frames 7A, 7B and the lateral frames 8A, 8B, a brace attachment plate 14 for attaching the braces 10A, 10B, and a fixing plate 11 for fixing the attachment member 12 to the foundation 2 or a beam member 4.

The attachment member 12 comprises a vertical frame attachment member 15 for attaching the vertical frames 7A, 7B, and a lateral frame attachment member (lateral fitting section) 16 for attaching the lateral frames 8A, 8B.

Figure 4:
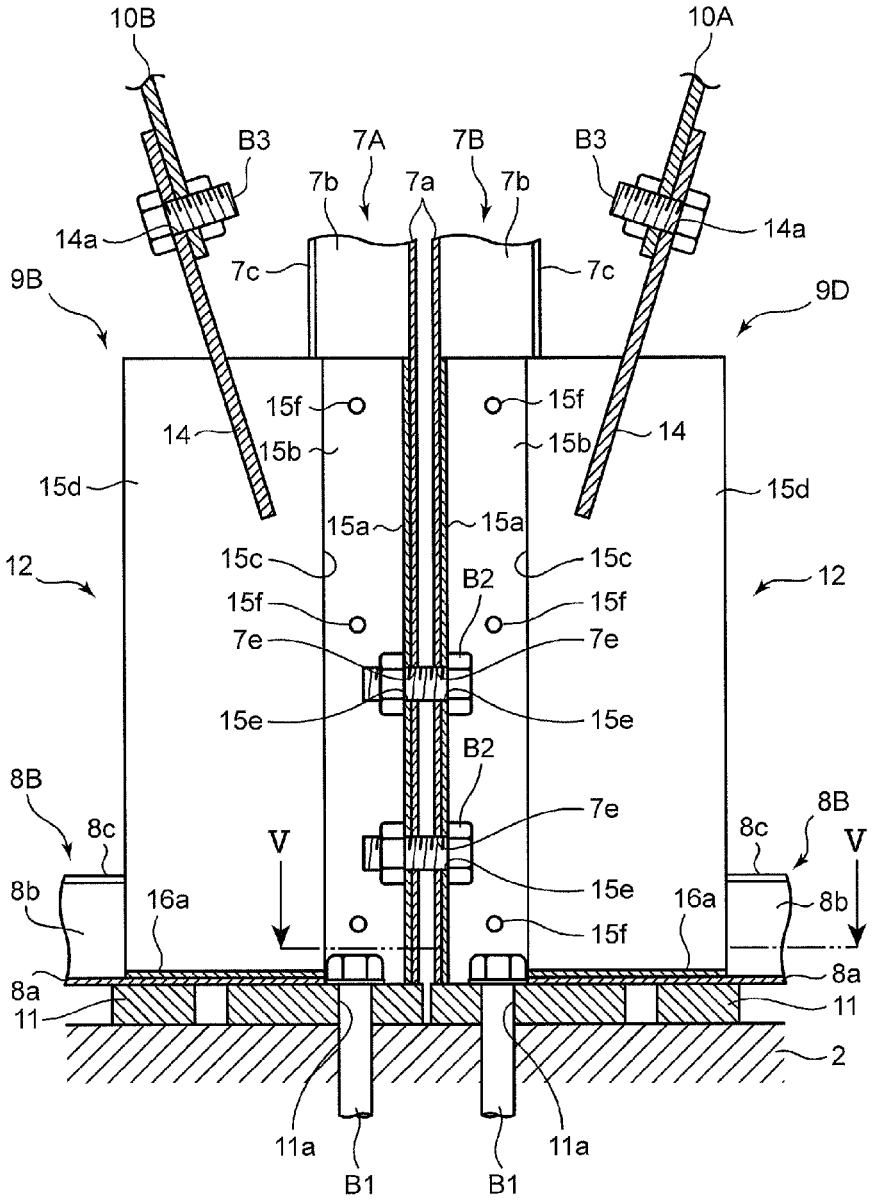
FIG. 4 is a front cross sectional view illustrating an enlargement of part of the house of FIG. 1.
Figure 5:
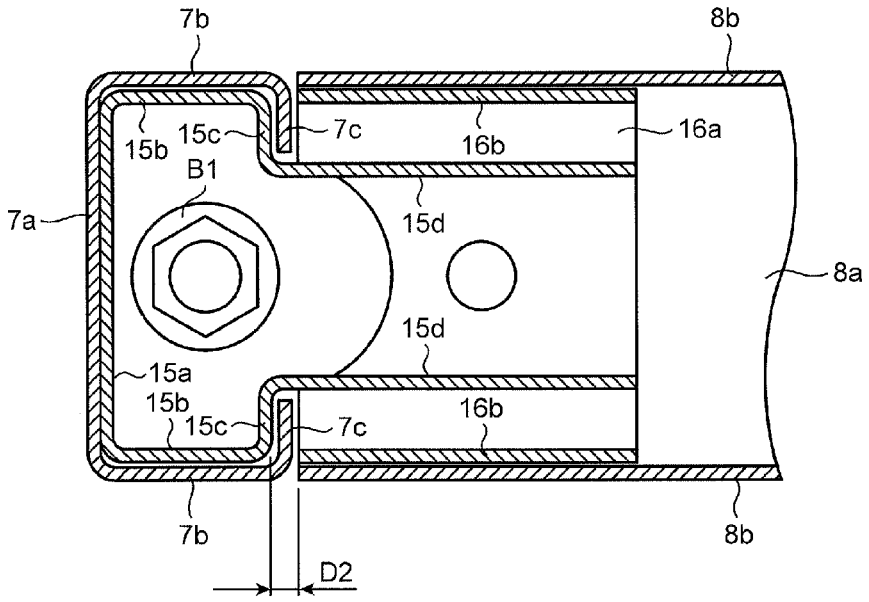
FIG. 5 is a cross-sectional view along line V-V in FIG. 4.

With reference to FIG. 3 to FIG. 5, the vertical frame attachment member 15 can be attached to the vertical frames 7A, 7B covering over the vertical frame attachment member 15. Specifically, the vertical frame attachment member 15 has a vertical frame attachment section 15*a* disposed along the inner surface of the vertical web 7*a*, a pair of vertical flange arrangement sections 15*b* disposed along the vertical flanges 7*h*, a pair of vertical lip arrangement sections 15*c* disposed along the vertical lips 7*c*, and a pair of extension sections 15*d* extending inward from respective end sections of the vertical lip arrangement sections 15*c*. In the present embodiment, the vertical frame attachment section 15*a*, the pair of vertical flange arrangement sections 15*b* and the pair of vertical lip arrangement sections 15*c* construct a vertical fitting section that enable fitting into the vertical frames 7A, 7B in the longitudinal direction of the vertical frames 7A, B. The vertical frame attachment member 15 has, integrally, the vertical frame attachment section 15*a*, the vertical flange arrangement sections 15*b*, the vertical lip arrangement sections 15*c*, and the pair of extension sections 15*d*. Accordingly, the vertical frame attachment member 15 is strong against the compressive force along the longitudinal direction of the vertical frames 7A, 7B. The end faces of the vertical frame attachment section 15*a*, the vertical flange arrangement sections 15*b* and the vertical lip arrangement sections 15*c* are butt-welded to the below-described fixing plate 11.

The vertical frame attachment section 15*a* can be attached to the vertical frames 7A, 7B by way of bolts (threaded members) B2. Specifically, the vertical frame attachment section 15*a* has two through-holes 15*e* formed at positions corresponding to the through-holes 7*e* of the vertical frames 7A, 7B. As illustrated in FIG. 4, bolts B2 are inserted into the through-holes 7*e*, 15*e*, and nuts are fastened to the bolts B2, so that the vertical frames 7A, 7B can be attached to the vertical frame attachment section 15*a* as a result. FIG. 4 illustrates a state where shared bolts B2 are used for two adjacent connecting fittings 9B, 9D, but there may be used one bolt B2 for each one of the connecting fittings 9A to 9D. Also, FIG. 4 illustrates a state where the connecting fittings 9B, 9D are connected to each other by way of the bolts B2, but the connecting fittings 9A to 9D may be connected to a pillar (not shown) by way of the bolts B2. The through-holes 15*f* formed in the vertical flange arrangement sections 15*b* are provided at positions corresponding to the through-holes 7*d* of the vertical frames 7A, 7B. The outer wall 6 can be attached to the bearing walls 5 through screwing of screws into the through-holes 7*d*, 15*f*.

With reference to FIG. 3 to FIG. 5, the extension sections 15*d* extend parallelly to each other from the vertical lip arrangement sections 15*c* at a spacing that enables passage between the pair of vertical lips 7*c*. The extension sections 15*d* extend from respective vertical lip arrangement sections 15*c* to a more inner position than the vertical lips 7*c*. As described below in more detail, the extension sections 15*d* are shorter than the vertical frame attachment section 15*a*, the vertical flange arrangement sections 15*b* and the vertical lip arrangement sections 15*c*, in such a manner that a gap D1 (FIG. 3) is formed between the extension sections 15*d* and the fixing plate 11.

The lateral frame attachment member 16 extends sideways from the pair of extension sections 15*d*, and can fit into the lateral frames 8A, 8B along the longitudinal direction of the lateral frames 8A, 8B. Specifically, the lateral frame attachment member 16 has a lateral web arrangement section 16*a* disposed along the lateral web 8*a*, a pair of lateral flanges arrangement sections 16*b* disposed along the lateral flanges 8*b*, and lateral lip arrangement sections 16*c* disposed along the lateral lips 8*c*. The lateral frame attachment member 16 is fixed to the extension sections 15*d* in such a manner that the gap D1 is formed between the lateral web arrangement section 16*a* and the fixing plate 11. Specifically, the lateral lip arrangement sections 16*c* are butt-welded to the extension sections 15*d* in a state where the end faces of the extension sections 15*d* contact to the lateral web arrangement section 16*a*. The gap D1 is a gap slightly larger than the thickness dimension of the lateral web 8*a* of the lateral frames 8A, 8B. The lateral frame attachment member 16 is disposed with a gap D2 (FIG. 5) between the lateral frame attachment member 16 and the vertical lip arrangement sections 15*c*, in such a manner that the vertical lips 7*c* can be sandwiched between the lateral frame attachment member 16 and the vertical lip arrangement sections 15*c*. The gap D2 is a gap slightly larger than the thickness dimension of the vertical lips 7*c*. The lateral flange arrangement sections 16*b* have two through-holes 16*d* formed at positions corresponding to the through-holes 8*d* of the lateral flanges 8*b*. The lateral frames 8A, 8B can be attached to the lateral frame attachment member 16 by screwing of screws into the through-holes 8*d*, 16*d*.

The brace attachment plate 14 is provided along a diagonal of the bearing wall 5. Specifically, part of the brace attachment plate 14 is butt-welded to the extension sections 15*d* in a state where the brace attachment plate 14 is disposed between the extension sections 15*d*. A through-hole 14*a* is provided in a portion of the brace attachment plate 14 which is led out from between the extension plates 15*d*. The braces 10A, 10B can each be attached by way of a bolt B3 that is inserted into this through-hole 14*a*.

The fixing plate 11 is a plate material to which the attachment member 12 is welded, for sandwiching the lateral web 8*a* between the fixing plate 11 and the lateral frame attachment member 16. Specifically, the vertical frame attachment section 15*a*, the vertical flange arrangement sections 15*b* and the vertical lip arrangement sections 15*c* are butt-welded on the face of the fixing plate 11. Part of the fixing plate 11 is disposed at a outer position of the lateral frame attachment member 16 with the gap D1 left therebetween. Through-holes 11*a* are formed in the fixing plate 11. The fixing plate 11 can be fixed to the foundation 2 or a beam member 4 by way of bolts B1 that are inserted into the through-holes 11*a*. The through-holes 11*a* are formed within an area surrounded by the vertical frame attachment section 15*a*, the vertical flange arrangement sections 15*b* and the vertical lip arrangement sections 15*c*.

The effect of the above embodiment will be explained with reference to FIG. 6.

Figure 6:
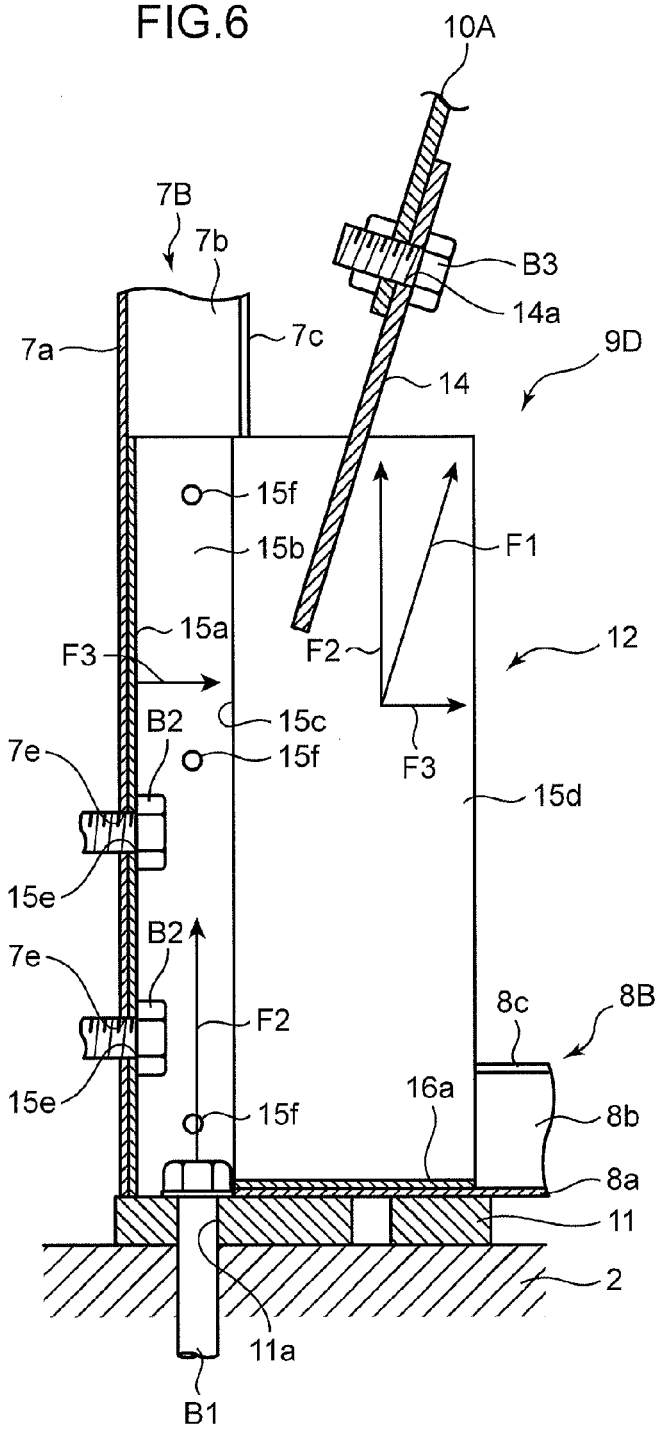
FIG. 6 is a front cross sectional view illustrating the manner in which a tensile force generated in a brace is transmitted.

As illustrated in FIG. 6, a tensile force F1 is assumed to act on the brace 10A. The tensile force F1 can be resolved into a vertical-direction component F2 and a lateral-direction component F3. In the present embodiment, the vertical frame attachment section 15*a* is disposed between the vertical web 7*a* and the brace attachment plate 14. Accordingly, the lateral-direction component F3 can be received by the vertical frame attachment section 15*a*. Therefore, it becomes possible to suppress direct transmission of the lateral-direction component F3 to the vertical frames 7A, 7B.

In the above embodiment, the attachment member 12 is welded to the fixing plate 11. Accordingly, the tensile force F1 can be transmitted effectively to the fixing plate 11. Therefore it is possible to suppress transmission of the tensile force F1 to the frames 7A, 7B, 8A, 8B. Accordingly, it is possible to suppress deformation of the frames 7A, 7B, 8A, 8B by the tensile force F1.

In the above embodiment, as described above, the vertical frame attachment section 15*a* is disposed along the inner surface of the vertical web 7*a* between the vertical frames 7A, 7B and the brace attachment plate 14, and the vertical frame attachment section 15*a* is welded to the fixing plate 11 that can be fixed to the foundation 2 or a beam member 4. As a result, the lateral-direction component F3 of the tensile force generated in the braces 10A, 10B can be received by the vertical frame attachment section 15*a* itself, and the lateral-direction component can be effectively transmitted to the foundation 2 or a beam member 4 via the fixing plate 11. Accordingly, it is possible to suppress that the lateral-direction component F3 of the tensile force transmitted from the braces 10A, 10B is directly transmitted to the vertical frames 7A, 7B. Deformation of the vertical frames 7A, 7B can be suppressed as a result.

In the above embodiment, the vertical frame attachment section 15*a* can be attached to the vertical frames 7A, 7B by way of the bolts B2. Accordingly, the production process of the bearing wall can be simplified as compared with an instance where the connecting fittings 9A to 9D are welded to the vertical frames 7A, 7B.

In the above embodiment, the vertical frames 7A, 7B have a cross-sectional shape in which the vertical web 7*a* and the pair of vertical flanges 7*b* extend in a direction along which the vertical web 7*a* and the vertical flanges 7*b* intersect each other and the pair of vertical flanges 7*b* and the pair of vertical lips 7*c* extend in a direction along which the vertical flanges 7*b* and the vertical lips 7*c* intersect each other. The vertical frames 7A, 7B are strong as a result against compressive forces. The connecting fittings 9A to 9D have a vertical fitting section (vertical frame attachment section 15*a*, vertical flange arrangement sections 15*b*, and vertical lip arrangement sections 15*c*) that can fit onto the vertical frames 7A, 7B in the longitudinal direction of the vertical frames 7A, 7B and the pair of extension sections 15*d* extending parallelly from the vertical fitting section through between the vertical lips 7*c*. The brace attachment plate 14 is provided in the pair of extension sections 15*d*. Accordingly, the vertical fitting section can fit with the vertical frames 7A, 7B without modification of the design of the vertical frames 7A, 7B that elicit strength against compressive force as described above. The brace attachment plate 14 can be provided in the pair of extension sections 15*d* extending from the vertical fitting section.

In the above embodiment, the vertical frame attachment section 15*a*, the pair of vertical flange arrangement sections 15*b*, the pair of vertical lip arrangement sections 15*c* and the pair of extension sections 15*d* are configured integrally. Specifically, the vertical frame attachment member 15 has a cross-sectional shape in which the vertical frame attachment section 15*a* and the pair of vertical flange arrangement sections 15*b* extend in a direction in which the vertical frame attachment section 15*a* and the vertical flange arrangement sections 15*b* intersect each other, the pair of vertical flange arrangement sections 15*b* and the pair of vertical lip arrangement sections 15*c* extend in a direction in which the vertical flange arrangement sections 15*b* and the vertical lip arrangement sections 15*c* intersect each other, and the pair of vertical lip arrangement sections 15*c* and the pair of extension sections 15*d* extend in a direction in which the vertical lip arrangement sections 15*c* and the extension sections 15*d* intersect each other. As a result, connecting fittings 9A to 9D (vertical frame attachment member 15) that do not deform (buckle) readily by the compressive force generated in the vertical frames 7A, 7B can be obtained. Accordingly, the vertical-direction component of the force generated in the braces 10A, 10B can be effectively transmitted to the fixing plate 11 (foundation 2 or beam members 4).

In the above embodiment, the lateral frames 8A, 8B have a cross-sectional shape in which the lateral web 8*a* and the pair of lateral flanges 8*b* extend in a direction in which the lateral web 8*a* and the lateral flanges 8*b* intersect each other, and the pair of lateral flanges 8*b* and the pair of lateral lips 8*c* extend in a direction in which the lateral flanges 8*b* and the lateral lips 8*c* intersect each other. The lateral frames 8A, 8B are strong as a result against compressive forces. The lateral frame attachment member (lateral fitting section) 16 can fit with the lateral frames 8A, 8B in the longitudinal direction of the lateral frames 8A, 8B. Accordingly, the lateral frame attachment member 16 can fit with the lateral frames 8A, 8B without modification of the design of the lateral frames 8A, 8B that elicit strength against compressive force as described above. In the above embodiment, moreover, the lateral frames 8A, 8B have a cross-sectional shape identical to that of the vertical frames 7A, 7B. Accordingly, the vertical frames 7A, 7B and the lateral frames 8A, 8B can be formed by cutting an elongate frame base material having the above cross-sectional shape. As a result, the overlap between the production processes of the vertical frames 7A, 7B and the lateral frames 8A, 8B can be broadened as compared with an instance where the cross-sectional shapes of the vertical frames 7A, 7B and the lateral frames 8A, 8B are different. The component cost of the frames 7A, 7B, 8A, 8B can be reduced accordingly.

In the above embodiment, the lateral frames 8A, 8B can be attached by way of screws through the use of the lateral flange arrangement sections 16*b* that are disposed along the pair of lateral flanges 8*b* of the lateral frames 8A, 8B.

In the above embodiment, the gap D1 that enables sandwiching of the lateral web 8*a* is formed between the lateral web arrangement section 16*a* and the fixing plate 11. As a result, the lateral frames 8A, 8B can be attached reliably to the lateral flange arrangement sections 16*b* in a state where the lateral web 8*a* is sandwiched between the lateral web arrangement section 16*a* and the fixing plate 11.

In the above embodiment, a gap that enables sandwiching of the vertical lips 7*c* in the thickness direction is formed between the vertical lip arrangement sections 15*c* and the lateral frame attachment member 16. As a result, the vertical frames 7A, 7B can fit with the vertical fitting section (vertical frame attachment section 15*a*, vertical flange arrangement section 15*b* and vertical lip arrangement section 15*c*) in a state where interference between the pair of vertical lips 7*c* and the lateral frame attachment member 16 is avoided, while maintaining the configuration of the vertical frames 7A, 7B (pair of vertical flanges 7*b* and pair of vertical lips 7*c*) that elicit strength against compressive forces.

Figure 7:
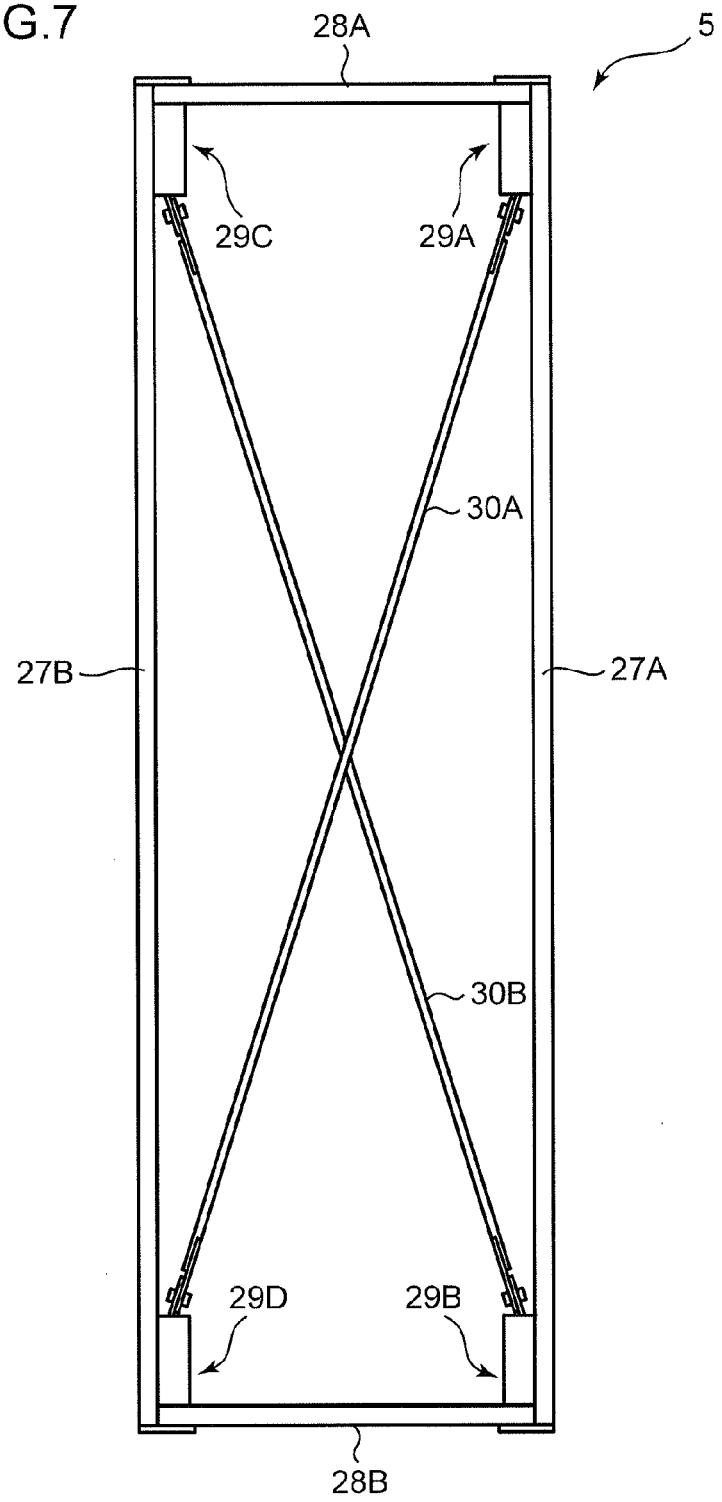
FIG. 7 is a front view of a bearing wall according to another embodiment of the present invention.

FIG. 7 is a front view of a bearing wall according to another embodiment of the present invention.

As described above, the bearing walls 5 are fixed to at least one of the foundation 2 and the beam members 4. Specifically, the hearing walls 5 comprise a pair of vertical frames 27A, 27B and a pair of lateral frames 28A, 28B disposed to make up a frame shape, four connecting fittings 29A to 29D connectable end sections of the vertical frames 27A, 27B and end sections of the lateral frames 28A, 28B, and two braces 30A, 30B supporting forces generated in the frames 27A, 27B, 28A, 28B. In the explanation below, the direction facing inward of the frame formed by the frames 27A, 27B, 28A, 28B will be referred to as inward direction, and the direction facing outward of the frame will be referred to as the outward direction.

Figure 8:
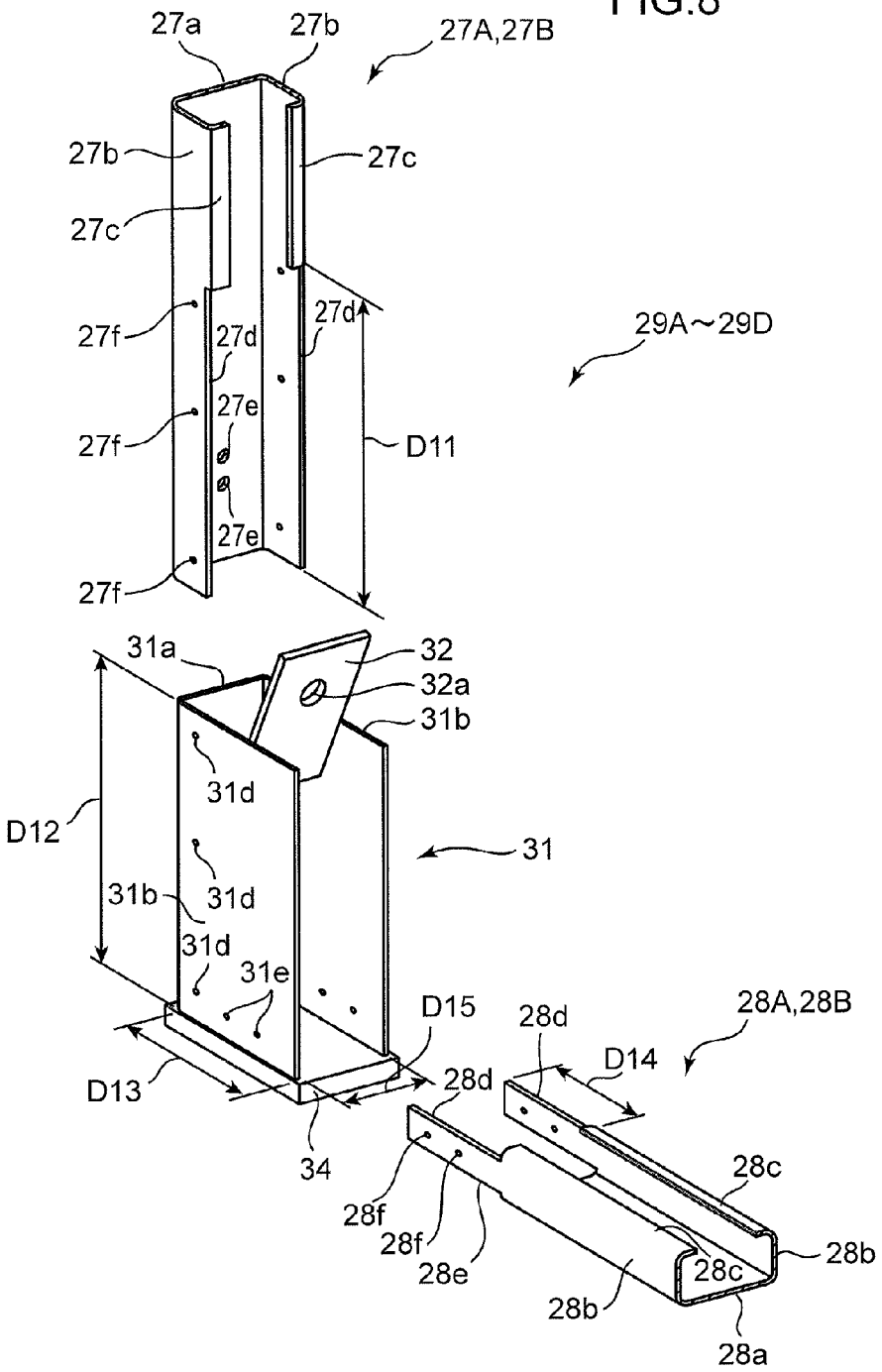
FIG. 8 is a perspective view illustrating an enlargement of a connecting fitting of the bearing wall of FIG. 7.

FIG. 8 is a perspective view illustrating an enlargement of a connecting fitting of the bearing wall of FIG. 7.

The vertical frames 27A, 27B are C-section steel farmed by a steel material having a thickness of 2.3 mm. Specifically, the vertical frames 27A, 27B comprise a vertical web 27*a*, a pair of vertical flanges 27*b* folded inward from both edges of the vertical web 27*a*, a pair of vertical lips 27*c* folded from respective leading ends of the vertical flanges 27*b* in a direction of coming close to each other, and a pair of vertical cutout sections 27*d* resulting from cutting out the pair of vertical lips 27*c* over a predetermined vertical area D11 from the ends of the vertical frames 27A, 27B. A pair of through-holes 27*e* aligned in the vertical direction is formed in the vertical web 27*a*, and three through-holes 27*f* aligned in the vertical direction are respectively formed in the pair of vertical flanges 27*b*.

The lateral frames 28A, 28B are C-section steel formed by a steel material having a thickness of 2.3 mm. The lateral frames 28A, 28B have a cross-sectional shape identical to that of the vertical frames 27A, 27B. Specifically, the lateral frames 28A, 28B have a lateral web 28*a*, a pair of lateral flanges 28*b* folded inward from both edges of the lateral web 28*a*, a pair of lateral lips 28*c* folded from respective leading ends of the lateral flanges 28*b* in a direction of coming close to each other, a first lateral cutout section 28*e* resulting from cutting out the lateral web 28*a* over a predetermined lateral area D14 from the ends of the lateral frame 28A, 28B, and a pair of second lateral cutout sections 28*d* resulting from cutting out the pair of lateral lips 28*c* over the lateral area D14. A pair of through-holes 28*f* aligned in the lateral-direction is respectively formed in the pair of lateral flanges 28*b*.

With reference to FIG. 7, the connecting fitting 29A connects an end section of the vertical frame 27A with an end section of the lateral frame 28A. The connecting fitting 29B connects an end section of the vertical frame 27A with an end section of the lateral frame 28B. The connecting fitting 29C connects an end section of the vertical frame 27B with an end section of the lateral frame 28A. The connecting fitting 29D connects an end section of the vertical frame 27B with an end section of the lateral frame 28B. The connecting fittings 29A, 29C can be fixed to the foundation 2 or a beam member 4 disposed along the outer surface of the lateral frames 28A. The connecting fittings 29B, 29D can be fixed to the foundation 2 or a beam member 4 disposed along the outer surface of the lateral frames 28B. The brace 30A is provided between the connecting fitting 29A and the connecting fitting 29D. The brace 30B is provided between the connecting fitting 29B and the connecting fitting 29C. The connecting fittings 29A to 29D have the same configuration.

With reference to FIG. 8, the connecting fittings 29A to 29D have an attachment member 31 for attaching the vertical frames 27A, 27B and the lateral frames 28A, 28B, a brace attachment plate 32 for attaching the braces 30A, 30B, and a fixing plate 34 for fixing the attachment member 31 to the foundation 2 or a beam member 4.

The attachment member 31 can be attached to the vertical frames 27A, 27B and the lateral frames 28A, 28B covering over the attachment member 31. Specifically, the attachment member 31 has a vertical frame attachment section 31*a* disposed along the inner surface of the vertical web 27*a*, and a pair of extension sections 31*b* that are folded at right angles from both edges of the vertical frame attachment section 31*a* and that extend parallelly along the pair of vertical flanges 27*b*. The attachment member 31 has thus a cross-sectional shape in which the vertical frame attachment section 31*a* and the pair of extension sections 31*b* intersect each other. Accordingly, the attachment member 31 is strong against the compressive force along the longitudinal direction of the vertical frames 27A, 27B. The end faces of the vertical frame attachment section 31*a* and the pair of extension sections 31*b* are butt-welded to the below-described fixing plate 34.

The vertical frame attachment section 31*a* and the pair of extension sections 31*b* have a height dimension D12 smaller than the predetermined vertical area D11 of the pair of vertical frames 27A, 27B. The pair of extension sections 31*b* has a projecting dimension D13 larger than a projecting dimension of the pair of vertical flanges 27*b*. Therefore, the pair of extension sections 31*b* is led inward from the vertical frames 27A, 27B through the pair of vertical cutout sections 27*d* in a state where the vertical frame attachment section 31*a* is disposed along the inner surface of the vertical web 27*a*. The dimension of the portion that is led out from the vertical frames 27A, 27B in the projecting dimension D13 of the pair of extension sections 31*b* is set to be larger than a predetermined lateral area D14 of the lateral frames 28A, 28B. Therefore, the lateral flanges 28*b* positioned within the predetermined lateral area D14 can be disposed so as to sandwich the extension sections 31*b* from outside.

Figure 9:
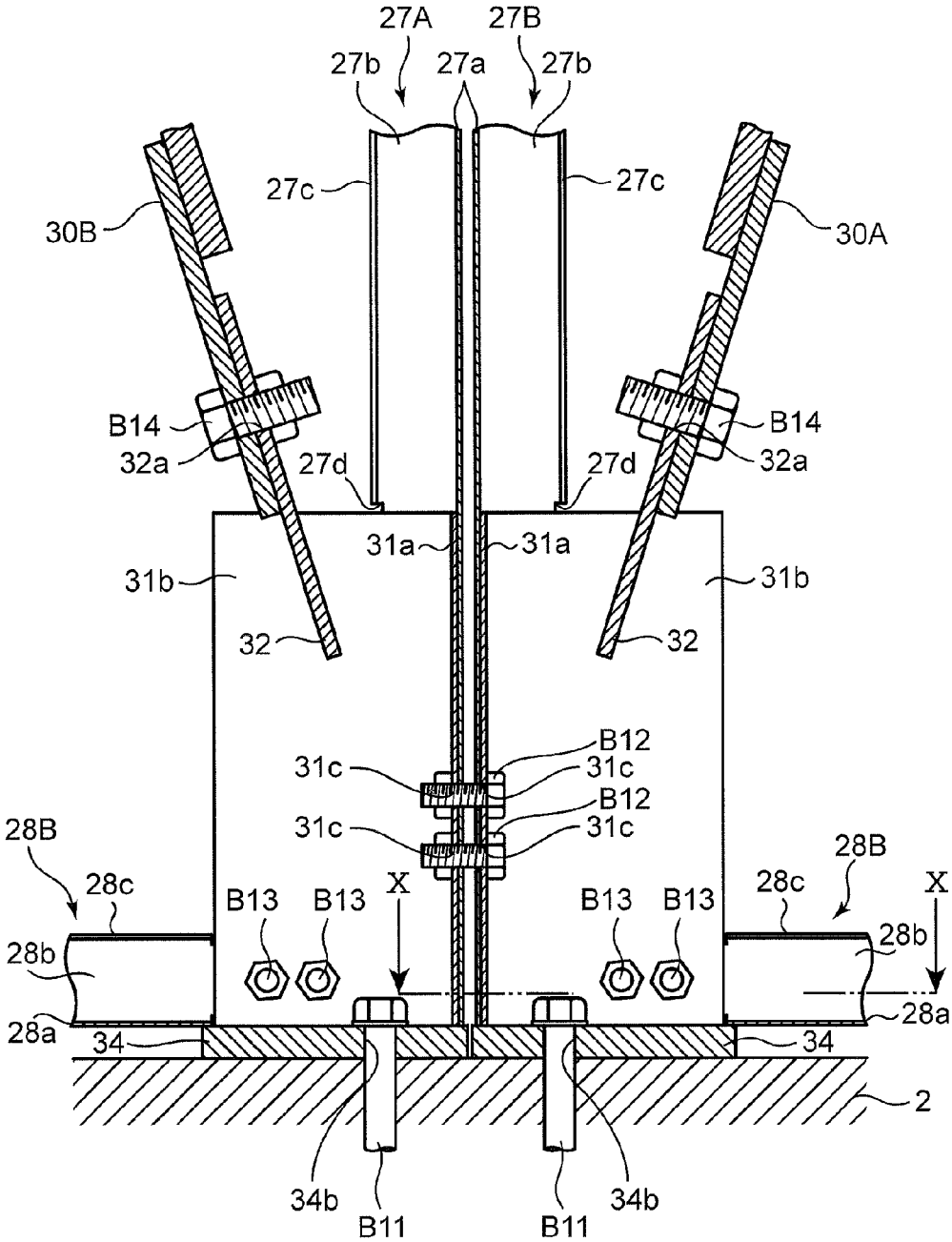
FIG. 9 is a front cross sectional view illustrating an enlargement of part of the house of FIG. 1.
Figure 10:
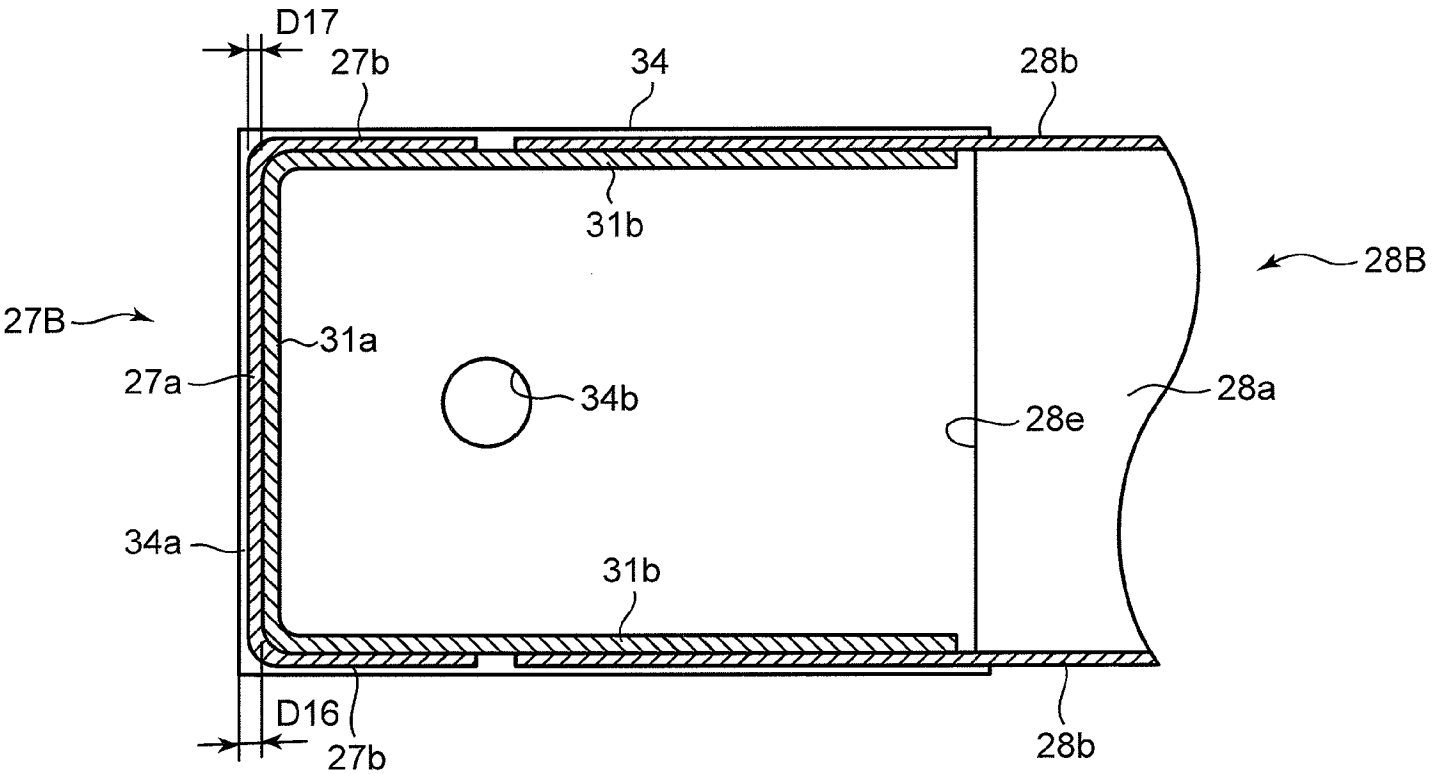
FIG. 10 is a cross sectional view along line X-X in FIG. 9.

With reference to FIG. 8 to FIG. 10, the vertical frame attachment section 31*a* can be attached to the vertical frames 27A, 27B by way of bolts (threaded members) B12. Specifically, the vertical frame attachment section 31*a* has two through-holes 31*c* formed at positions corresponding to the through-holes 27*e* of the vertical frames 27A, 27B. As illustrated in FIG. 9, bolts B12 are inserted into the through-holes 27*e*, 31*c* and nuts are fastened to the bolts B12, so that the vertical frames 27A, 27B can be attached to the vertical frame attachment section 31*a* as a result. FIG. 9 illustrates a state where shared bolts B12 are used for two adjacent connecting fittings 29B, 29D, but there may be used one bolt B12 for each one of the connecting fittings 29A to 29D. FIG. 9 illustrates a state where the connecting fittings 29B, 29D are connected to each other by way of the bolts B12, but the connecting fittings 29A to 29D may be connected to a pillar (not shown). Through-holes 31*d* formed in the pair of extension sections 31*b* are disposed at positions corresponding to the through-holes 27*f* of the vertical frames 27A, 27B. The outer wall 6 can be attached to the bearing walls 5 through screwing of screws into the through-holes 27*f*, 31*d*.

With reference to FIG. 8 to FIG. 10, the pair of extension sections 31*b* extends parallelly to each other along the pair of vertical flanges 27*b*. The pair of extension sections 31*b* can be attached to the lateral frames 28A, 28B by way of bolts (threaded members) B13. Specifically, the pair of extension sections 31*b* have two through-holes (lateral frame attachment sections) 31*e* formed at positions corresponding to the through-holes 28*f* of the lateral frames 28A, 28B. The lateral frames 28A, 28B can be attached to the pair of extension sections 31*b* by insertion of the bolts B13 into the through-hole 28*f*, 31*e* and fastening of nuts onto the bolts B13.

The brace attachment plate 32 is provided along a diagonal of the bearing wall 5. Specifically, the brace attachment plate 32 is a substantially rectangular plate material having a width dimension D15 (FIG. 8) that corresponds to the distance between the opposing faces of the pair of extension sections 31*b*. Part of the brace attachment plate 32 is butt-welded to the pair of extension sections 31*b* in a state where the brace attachment plate 32 is disposed between the pair of extension sections 31*b*. In the present embodiment, thus, the brace, attachment plate 32 is provided between the pair of extension sections 31*b* that is led out inward from the vertical frames 27A, 27B through the pair of vertical cutout sections 27*d*. As a result, it becomes possible to increase the width dimension D15 of the brace attachment plate 32 as compared with an instance where the pair of extension sections, that are led out inward of the vertical frames 27A, 27B through between the pair of vertical lips 27*c* without forming the pair of vertical cutout sections 27*d*, is provided, and the brace attachment section is provided between the extension sections. Therefore, it becomes possible to increase the strength of the brace attachment plate 32 against the tensile force generated in the braces 30A, 30B. A through-hole 32*a* is provided in a portion of the brace attachment plate 32 led out from between the extension plates 31*b*, 31*d*. The braces 30A, 30B can each be attached by way of a bolt B14 that is inserted into this through-hole 32*a*.

The attachment member 31 is welded to the fixing plate 34, and the fixing plate 34 can be fixed to the foundation 2 or a beam member 4. Specifically, the attachment member 31 is butt-welded to the face of the fixing plate 34. Through-holes 34*b* are formed in the fixing plate 34. The fixing plate 34 can be fixed to the foundation 2 or a beam member 4 by way of bolts B11 that are inserted into the through-holes 34*b*. The through-holes 34*b* are formed within an area surrounded by the vertical frame attachment section 31*a* and the pair of extension sections 31*b*. As illustrated in FIG. 10, the area outward of the vertical frame attachment section 31*a* within the face of the fixing plate 34 yields an contact surface 34*a* that can contact the entire end face of the vertical web 27*a* that is attached to the vertical frame attachment section 31*a*. The contact surface 34*a* protrudes outward of the vertical frame attachment section 31*a* by a width dimension D16 that is larger than a dimension D17 that extends from the outer surface of the vertical frame attachment section 31*a* to the outer surface of the vertical web 27*a*. In the present embodiment, there is provided the contact surface 34*a* having the width dimension D16 larger than the dimension D17, but it is sufficient for the width dimension D16 of the contact surface 34*a* to be at least as large as the dimension D17.

The effect of the above embodiment will be explained with reference to FIG. 11.

Figure 11:
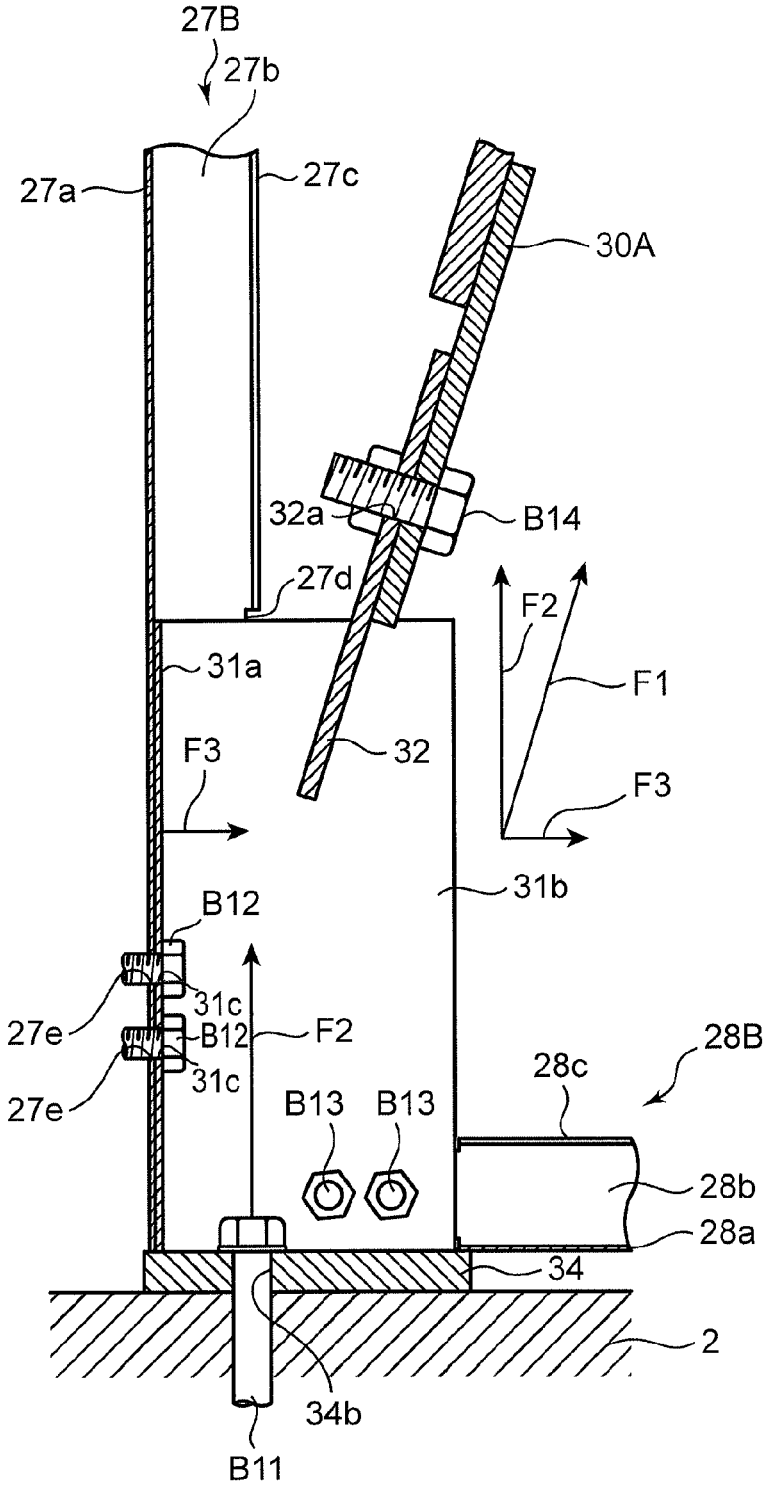
FIG. 11 is a front cross sectional view illustrating the manner in which a tensile force generated in a brace is transmitted.

As illustrated in FIG. 11, a tensile force F1 is assumed to act on the brace 30A. The tensile force F1 can be resolved into a vertical-direction component F2 and a lateral-direction component F3. In the present embodiment, the vertical frame attachment section 31*a* is disposed between the vertical web 27*a* and the brace attachment plate 32. Accordingly, the lateral-direction component F3 can be received by the vertical frame attachment section 31*a*. Therefore, it becomes possible to suppress direct transmission of the lateral-direction component F3 to the vertical frames 27A, 27B.

In the above embodiment, the attachment member 31 is welded to the fixing plate 34. Accordingly, the tensile force F1 can be transmitted effectively to the fixing plate 34. It becomes therefore possible to suppress transmission of the tensile force F1 to the frames 27A, 27B, 28A, 28B. Accordingly, it is possible to suppress deformation of the frames 27A, 27B, 28A, 28B by the tensile force F1.

In the above embodiment, as described above, the vertical frame attachment section 31*a* is disposed along the inner surface of the vertical web 27*a* between the vertical web 27*a* and the brace attachment plate 32, and the vertical frame attachment section 31*a* is welded to a fixing plate 34 that can be fixed to the foundation 2 or a beam member 4. As a result, the lateral-direction component F3 of the tensile force F1 that is generated in the braces 30A, 30B can be received by the vertical frame attachment section 31*a* itself, and the lateral-direction component F3 can be effectively transmitted to the foundation 2 or a beam member 4 via the fixing section. Accordingly, it is possible that the lateral-direction component F3 of the tensile force F1 transmitted from the braces 30A, 30B is directly transmitted to the vertical frames 27A, 27B. Deformation of the vertical frames 27A, 27B can be suppressed as a result.

In the above embodiment, the pair of extension sections 31*b* extends parallelly from the vertical frame attachment section 31*a* along the pair of vertical flanges 27*b*, and is led out inward of the vertical frames 27A, 27B through the pair of vertical cutout sections 27*d*. As a result, it is possible to widen the spacing between the pair of extension sections 31*b* as compared with an instance where the pair of vertical lips 27*c* of the vertical frames 27A, 27B is left and the pair of extension sections is formed with a spacing so as to enable passing between the pair of vertical lips. The brace attachment plate 32 is welded across the extension sections 31*b*. Therefore, it is possible to increase the width D15 of the brace attachment plate 32 in accordance with the breadth of the spacing between the extension sections 31*b*. Accordingly, according to the present invention, the strength of the brace attachment plate 32 against the tensile force F1 from the braces 30A, 30B can be increased.

In the above embodiment, the vertical frame attachment section 31*a* can be attached to the vertical frames 27A, 27B by way of the bolts B12. Accordingly, the production process of the bearing walls 5 can be simplified as compared with an instance where the connecting fittings 29A to 29D are welded to the vertical frames 27A, 27B.

In the above embodiment, the portion outside the predetermined lateral area D14 in the lateral frames 28A, 28B has the same cross-sectional shape as the portion outside the predetermined vertical area D11 in the vertical frames 27A, 27B. Therefore, it is possible to reduce the component cost of the vertical frames 27A, 27B and the lateral frames 28A, 28B. Specifically, for instance, the vertical frames 27A, 27B and the lateral frames 28A, 28B can be formed by cutting an elongate frame base material having the above cross-sectional shape. As a result, the overlap between the production processes of the vertical frames 27A, 27B and the lateral frames 28A, 28B can be broadened as compared with an instance where the cross-sectional shapes of the vertical frames 27A, 27B and the lateral frames 28A, 28B are different. In the above embodiment, moreover, the lateral frames 28A, 28B having the same cross-sectional shape as the vertical frames 27A, 27B have the first lateral cutout section 28*e* and the pair of second lateral cutout sections 28*d*. Therefore, the pair of lateral flanges 28*b* positioned in the predetermined lateral area D14 can be disposed so as to sandwich the pair of extension sections 31*b* that extend parallelly along the inner surface of the vertical flanges 27*b* of the vertical frames 27A, 27B. The pair of lateral flanges 28*b* can be attached by the way of screwing, by utilizing the pair of extension sections 31*b*.

In the above embodiment, the fixing plate 34 has the contact surface 34*a* that can contact the entire end face of the vertical web 27*a*. As a result, the compressive force generated by the vertical frame 27A, 27B can be received by the fixing plate 34. Therefore, the compressive force generated in the vertical frames 27A, 27B can be reliably transmitted to the foundation 2 or a beam member 4 via the fixing plate 34.

In the above embodiment, the vertical frame attachment section 31*a* and the pair of extension sections 31*b* are configured integrally with each other. That is, the attachment member 31 has a cross-sectional shape such that the vertical frame attachment section 31*a* and the pair of extension sections 31*b* extend in a direction in which the vertical frame attachment section 31*a* and the extension sections 31*b* intersect each other. As a result, connecting fittings 29A to 29D can be obtained that do not deform (buckle) readily by the compressive force generated in the vertical frames 27A, 27B. Accordingly, the vertical-direction component of the force generated in the braces 30A, 30B can be effectively transmitted to the foundation 2 or the beam members 4 via the fixing plate 34.

In the above embodiment, not only the vertical frame attachment section 31*a* but also the pair of extension sections 31*b* is welded to the fixing plate. As a result, the tensile force F1 from the brace attachment plate 32 can be transmitted yet more reliably to the fixing plate 34.

The specific embodiments above include mainly the inventions having the features below.

In order to solve the above problems, the present invention provides a connecting fitting used for forming a bearing wall which includes a pair of vertical frames and a pair of lateral frames disposed to make up a frame shape and braces that support forces generated in the vertical frames and the lateral frames, and which is fixed to at least one of a foundation and a beam member of a building, the connecting fitting being capable of connecting an end section of each vertical frame and an end section of each lateral frame, and including: a vertical frame attachment section that can be attached to an inner surface of the vertical frame, by way of a threaded member, in a state where the vertical frame attachment section is disposed along the inner surface of the vertical frame facing inward in a state of being disposed to make up a frame shape; a brace attachment section, connected to the vertical frame attachment section, which enables attachment of an end of the brace at a position inward of the vertical frame attachment section; and a fixing plate, welded to the vertical frame attachment section, which can be fixed to the beam member or the foundation in a state where the fixing plate is disposed along an outer surface of the lateral frame facing outward in a state of being disposed to make up a frame shape.

According to the present invention, the vertical frame attachment section is disposed along the inner surface of the vertical frame between the vertical frame and the brace attachment section, and the vertical frame attachment section is welded to the fixing section that can be fixed to a foundation or a beam member. As a result, this allows the lateral-direction component of the tensile force that is generated in the braces to be received by the vertical frame attachment section itself, and allows the lateral-direction component to be effectively transmitted to the foundation or the beam member by way of the fixing section. Accordingly, it becomes possible to suppress direct transmission, to the vertical frames, of the lateral-direction component of the tensile force transmitted from the braces. Deformation of the vertical frames can be suppressed as a result.

In the present invention, the vertical frame attachment section can be attached to the vertical frame by way of a threaded member. Accordingly, the production process of the bearing wall can be simplified as compared with an instance where the connecting fitting is welded to the vertical frame.

In the connecting fitting, preferably, each vertical frame has a vertical web, a pair of vertical flanges rising inward from both edges of the vertical web, and a pair of vertical lips extending, from the pair of vertical flanges in a direction of coming close to each other; the connecting fitting further includes a vertical fitting section capable of fitting into the vertical frame along the longitudinal direction of the vertical frame, and a pair of extension sections extending parallelly to each other from the vertical fitting section at a spacing that enables passage between the pair of vertical lips; and the brace attachment section is welded to the pair of extension sections in a state where the brace attachment section is disposed so as to straddle across the pair of extension sections.

In this aspect, the vertical frame has a cross-sectional shape such that the vertical web and the pair of vertical flanges extend in a direction along which the vertical web and the vertical flanges intersect each other, and such that the pair of vertical flanges and the pair of vertical lips extend in a direction along which the vertical web and the vertical flanges intersect each other. The vertical frames are strong as a result against compressive forces. The connecting fitting has a vertical fitting section that can fit onto the vertical frame in the longitudinal direction of the vertical frame, and a pair of extension sections extending parallelly from the vertical fitting section thorough between the vertical lips, such that a brace attachment section is provided in the pair of extension sections. Accordingly, the vertical fitting section can fit with the vertical frames without modification of the design of the vertical frames that elicit strength against compressive force, as described above. It becomes also possible to provide the brace attachment section in the pair of extension sections that extend from the vertical fitting section.

In the connecting fitting, preferably, the vertical fitting section includes the vertical frame attachment section disposed along the vertical web, a pair of vertical flange arrangement sections disposed along the pair of vertical flanges, and a pair of vertical lip arrangement sections disposed along the pair of vertical lips; wherein the vertical frame attachment section, the pair of vertical flange arrangement sections, the pair of vertical lip arrangement sections and the pair of extension sections are configured integrally.

In this aspect, the vertical frame attachment section, the pair of vertical flange arrangement sections, the pair of vertical lip arrangement sections and the pair of extension sections are configured integrally. That is, a member is formed having a cross-sectional shape such that the vertical frame attachment section and the pair of vertical flange arrangement sections extend in a direction in which the vertical frame attachment and the vertical flange arrangement sections intersect each other, the pair of vertical flange arrangement sections and the pair of vertical lip arrangement sections extend in a direction in which the vertical flange arrangement sections and the vertical lip arrangement sections intersect each other, and the pair of vertical lip arrangement sections and the pair of extension sections extend in a direction in which the vertical lip arrangement sections and the extension sections intersect each other. As a result, a connecting fitting can be obtained that does not deform (buckle) readily on account of the compressive force generated in the vertical frames. Accordingly, the vertical-direction component of the forces generated in the braces can be transmitted effectively to the fixing section (foundation or beam member).

In the connecting fitting, preferably, each lateral frame has a lateral web, a pair of lateral flanges rising inward from both edges of the lateral web, and a pair of lateral lips extending from the pair of lateral flanges in a direction of coming close to each other, and has a cross-sectional shape identical to the cross-sectional shape of the vertical frame; and the connecting fitting further includes a lateral fitting section, provided in the pair of extension sections, which can fit into the lateral frame along the longitudinal direction of the lateral frame.

In this aspect, the lateral frame has a cross-sectional shape such that the lateral web and the pair of lateral flanges extend in a direction in which the lateral web and the lateral flanges intersect each other, and the pair of lateral flanges and the pair of lateral lips extend in a direction in which the lateral flanges and the lateral lips intersect each other. The lateral frames are strong as a result against compressive forces. The connecting fitting has a lateral fitting section that can fit onto the lateral frame in the longitudinal direction of the lateral frame. Accordingly, the lateral fitting section can fit with the lateral frames without modification of the design of the lateral frames that elicit strength against compressive force, as described above. In the aspect, moreover, the lateral frames have a cross-sectional shape identical to that of the vertical frames. The component cost of the vertical frames and the lateral frames can be reduced accordingly. Specifically, for instance, the vertical frames and the lateral frames can be formed by cutting an elongate frame base material having the above cross-sectional shape. As a result, the overlap between the production processes of the vertical frames and the lateral frames can be broadened as compared with an instance where the cross-sectional shapes of the vertical frames and the lateral frames are different. The component cost of the frames can be reduced accordingly.

In the connecting fitting, preferably, the lateral fitting section has a lateral web arrangement section disposed along the lateral web, a pair of lateral flange arrangement sections disposed along the pair of lateral flanges, and a pair of lateral lip arrangement sections disposed along the pair of lateral lips; and the pair of lateral flange arrangement sections that can be attached to the lateral flanges by way of threaded members.

In this aspect, the lateral frames can be attached to the connecting fitting by way of threaded members through the use of the lateral flange arrangement sections that are disposed along the pair of lateral flanges of the lateral frames.

In the connecting fitting, preferably, a gap that enables sandwiching of the lateral web in a thickness dimension is formed between the lateral web arrangement section and the fixing plate.

In this aspect, the gap that enables sandwiching of the lateral web is formed between the lateral web arrangement section and the fixing plate. As a result, the lateral frames can be attached reliably to the lateral flange arrangement sections in a state where the lateral web is sandwiched between the lateral web arrangement section and the fixing plate.

In the connecting fitting, preferably, the vertical fitting section is stood on the fixing plate, and a gap that enables sandwiching of the pair of vertical lips in a thickness direction is formed between the vertical fitting section and the lateral fitting section.

In this configuration, a gap that enables sandwiching of the pair of vertical lips in a thickness direction is formed between the vertical fitting section and the lateral fitting section. As a result, the vertical frames can fit with the vertical fitting section in a state where interference between pair of vertical lips and the lateral fitting section is avoided, while maintaining the configuration of the vertical frames (pair of vertical flanges and pair of vertical lips) that elicit strength against compressive forces.

In the connecting fitting, preferably, each vertical frame has a vertical web, a pair of vertical flanges rising from both edges of the vertical web, a pair of vertical lips extending from the pair of vertical flanges in a direction of coming close to each other, and a pair of vertical cutout sections resulting from cutting out the pair of vertical lips over a predetermined vertical area from an end of the vertical frame; the vertical frame attachment section can be attached to an inner surface of the vertical web, by way of a threaded member, in a state where the vertical frame attachment section is disposed along the inner surface of the vertical web facing inward in a state of being disposed to make up a frame shape; the connecting fitting further includes a pair of extension sections, extending parallelly along the pair of vertical flanges from both edges of the vertical frame attachment section, which are led out inward from the vertical frame through the pair of vertical cutout sections; and the brace attachment section is welded to the pair of extension sections in a state where the brace attachment section is disposed so as to straddle across the pair of extension sections, such that the brace attachment section enables attachment of an end of the brace at a position inward of the vertical frame attachment section.

In this aspect, the pair of extension sections extends parallelly from the vertical frame attachment section along the pair of vertical flanges, and is led out inward of the vertical frame through the pair of cutout sections. As a result, it becomes possible to widen the spacing between the pair of extension sections as compared with an instance where the pair of vertical lips of the vertical frames is left and the pair of extension sections is formed with a spacing therebetween so as to enable passing between the pair of vertical lips. The brace attachment section is welded across the extension sections. Therefore, it becomes possible to increase the width of the brace attachment section in accordance with the breadth of the spacing between the extension sections. Accordingly, the present invention allows increasing the strength of the brace attachment section against the tensile force from the brace.

In the aspect, moreover, the vertical frame attachment section can be attached to the vertical frame by way of a threaded member. Accordingly, the production process of the bearing wall can be simplified as compared with an instance where the connecting fitting is welded to the vertical frame.

In the connecting fitting, preferably, each lateral frame has a lateral web, a pair of lateral flanges rising inward from both edges of the lateral web, a pair of lateral lips extending from the pair of lateral flanges in a direction of coming close to each other, a first lateral cutout section resulting from cutting out the lateral web over a predetermined lateral area from an end of the lateral frame, and a pair of second lateral cutout sections resulting from cutting out the pair of lateral lips over the predetermined lateral area, and has a cross-sectional shape, identical to the cross-sectional shape of the vertical frame over an area outside the predetermined vertical area, over an area outside the predetermined lateral area; the pair of extension sections that can be attached, by way of threaded members, to the pair of lateral flanges that are positioned within the predetermined lateral area and are disposed so as to sandwich the pair of extension sections.

In this aspect, the portion outside the predetermined lateral area in the lateral frame has the same cross-sectional shape as the portion outside the predetermined vertical area in the vertical frame. Therefore, it is possible to reduce the component cost of the vertical frames and the lateral frames. Specifically, for instance, the vertical frames and the lateral frames can be formed by cutting an elongate frame base material having the above cross-sectional shape. As a result, the overlap between the production processes of the vertical frames and the lateral frames can be broadened as compared with an instance where the cross-sectional shapes of the vertical frames and the lateral frames are different. The component cost of the frames can be reduced accordingly. In the above aspect, moreover, the lateral frames having the same cross-sectional shape as that of the vertical frames have a first lateral cutout section and a pair of second lateral cutout sections. Therefore, the pair of lateral flanges positioned in the predetermined lateral area can be disposed so as to sandwich the pair of extension sections extending parallelly along the inner surface of the vertical flanges of the vertical frame. The pair of lateral flanges can be attached by way of threaded members, by utilizing the pair of extension sections.

In the connecting fitting, preferably, the fixing plate has an contact surface that can contact an entire end face of the vertical web that is attached to the vertical frame attachment section.

In this aspect, the fixing plate has an contact surface that can contact the entire end face of the vertical web. As a result, the compressive force generated by the vertical frame can be received by the fixing plate. Therefore, the compressive force generated in the vertical frame can be reliably transmitted to the foundation or the beam member via the fixing plate.

In the connecting fitting, preferably, the vertical frame attachment section and the pair of extension sections are configured integrally.

In this aspect, the vertical frame attachment section and the pair of extension sections are configured integrally. That is, a member having a cross-sectional shape such that the vertical frame attachment section and the pair of extension sections extend in a direction in which the vertical frame attachment section and the extension sections intersect each other is formed. As a result, a connecting fitting can be obtained that does not deform (buckle) readily by the compressive force generated in the vertical frame. Accordingly, the vertical-direction component of the forces generated in the brace can be transmitted effectively to the fixing section (foundation or beam member).

In the connecting fitting, preferably, the pair of extension sections is welded to the fixing plate.

In this aspect, not only the vertical frame attachment section but also the pair of extension sections are welded to the fixing plate. As a result, the tensile force from the brace attachment section can be transmitted yet more reliably to the fixing plate.

The present invention provides also a bearing wall that is fixed to at least one of a foundation and a beam member of a building, the bearing wall including: a pair of vertical frames and a pair of lateral frames disposed to make up a frame shape; four connecting fittings capable of connecting end sections of the vertical frames and end sections of the lateral frames; and two braces each provided between two connecting fittings which are disposed in a diagonal of the frame shape among the four connecting fittings, the braces supporting forces generated in the vertical frames and the lateral frames, wherein the four connecting fittings are the above connecting fitting.

Further, the present invention provides a building that includes a foundation; a beam member; and the above bearing wall fixed to at least one of the foundation and the beam member.

INDUSTRIAL APPLICABILITY

According to the present invention, deformation of frames derived from tensile forces that are inputted from braces can be suppressed.

B2, B12, B13 bolt (threaded member)
D11 vertical area
D14 lateral area
F1 tensile force
F2 vertical-direction component of tensile force
F3 lateral-direction component of tensile force
1 house (example of a building)
2 foundation
4 beam member
5 bearing wall
7A, 7B, 27A, 27B vertical frame
7*a*, 27*a* vertical web
7*b*, 27*b* vertical flange
7*c*, 27*c* vertical lip
8A, 8B, 28A, 28B lateral frame
8*a*, 28*a* lateral web
8*b*, 28*b* lateral flange
8*c*, 28*c* lateral lip
9A to 9D, 29A to 29D connecting fitting
10A, 10B, 30A, 30B brace
11, 34 fixing plate
14, 32 brace attachment plate (example of a fixing section)
15*a* vertical frame attachment section (example of a vertical fitting section)
15*b* vertical flange arrangement section (example of a vertical fitting section)
15*c* vertical lip arrangement section (example of a vertical fitting section)
15*d* extension section
16 lateral frame attachment member (example of a lateral fitting section)
27*d* vertical cutout section
28*d* second lateral cutout section
28*e* first lateral cutout section
31 attachment member
31*a* vertical frame attachment section
31*b* extension section
34*a* contact surface

The invention claimed is:

1. A connecting fitting used for forming a bearing wall which includes a pair of vertical frames and a pair of lateral frames disposed to make up a frame shape and braces that support forces generated in the vertical frames and the lateral frames, and which is fixed to at least one of a foundation and a beam member of a building, the connecting fitting being capable of connecting an end section of each vertical frame and an end section of each lateral frame, and comprising:

a vertical frame attachment section that can be attached to an inner surface of the vertical frame, by way of a threaded member, in a state where the vertical frame attachment section is disposed along the inner surface of the vertical frame facing inward in a state of being disposed to make up a frame shape;

a brace attachment section, connected to the vertical frame attachment section, which enables attachment of an end of the brace at a position inward of the vertical frame attachment section; and a fixing plate, welded to the vertical frame attachment section, which can be fixed to the beam member or the foundation in a state where the fixing plate is disposed along an outer surface of the lateral frame facing outward in a state of being disposed to make up a frame shape;

wherein each vertical frame has a vertical web, a pair of vertical flanges rising inward from both edges of the vertical web, and a pair of vertical lips extending from the pair of vertical flanges in a direction of coming close to each other;

the connecting fitting further comprises a vertical fitting section capable of fitting into the vertical frame along the longitudinal direction of the vertical frame, and a pair of extension sections extending parallelly to each other from the vertical fitting section at a spacing that enables passage between the pair of vertical lips; and the brace attachment section is welded to the pair of extension sections in a state where the brace attachment section is disposed so as to straddle across the pair of extension sections.

2. The connecting fitting according to claim 1, wherein the vertical fitting section comprises the vertical frame attachment section disposed along the vertical web, a pair of vertical flange arrangement sections disposed along the pair of vertical flanges, and a pair of vertical lip arrangement sections disposed along the pair of vertical lips; and the vertical frame attachment section, the pair of vertical flange arrangement sections, the pair of vertical lip arrangement sections and the pair of extension sections are configured integrally.

3. The connecting fitting according to claim 1, wherein each lateral frame has a lateral web, a pair of lateral flanges rising inward from both edges of the lateral web, and a pair of lateral lips extending from the pair of lateral flanges in a direction of coming close to each other, and has a cross-sectional shape identical to the cross-sectional shape of the vertical frame; and the connecting fitting further comprises a lateral fitting section, provided in the pair of extension sections, which can fit into the lateral frame along the longitudinal direction of the lateral frame.

4. The connecting fitting according to claim 3, wherein the lateral fitting section has a lateral web arrangement section disposed along the lateral web, a pair of lateral flange arrangement sections disposed along the pair of lateral flanges, and a pair of lateral lip arrangement sections disposed along the pair of lateral lips; and the pair of lateral flange arrangement sections that can be attached to the lateral flanges by way of threaded members.

5. The connecting fitting according to claim 4, wherein a gap that enables sandwiching of the lateral web in a thickness dimension is formed between the lateral web arrangement section and the fixing plate.

6. The connecting fitting according to claim 1, wherein the vertical fitting section is stood on the fixing plate, and a gap that enables sandwiching of the pair of vertical lips in a thickness direction is formed between the vertical fitting section and the lateral fitting section.

7. A bearing wall that is fixed to at least one of a foundation and a beam member of a building, the bearing wall comprising:

a pair of vertical frames and a pair of lateral frames disposed to make up a frame shape;

four connecting fittings capable of connecting end sections of the vertical frames and end sections of the lateral frames; and two braces each provided between two connecting fittings which are disposed in a diagonal of the frame shape among the four connecting fittings, the braces supporting forces generated in the vertical frames and the lateral frames, wherein the four connecting fittings are the connecting fitting according to claim 1.

8. A building, comprising:

a foundation;

a beam member; and the bearing wall according to claim 7, fixed to at least one of the foundation and the beam member.

9. A connecting fitting used for forming a bearing wall which includes a pair of vertical frames and a pair of lateral frames disposed to make up a frame shape and braces that support forces generated in the vertical frames and the lateral frames, and which is fixed to at least one of a foundation and a beam member of a building, the connecting fitting being capable of connecting an end section of each vertical frame and an end section of each lateral frame, and comprising:

a vertical frame attachment section that can be attached to an inner surface of the vertical frame, by way of a threaded member, in a state where the vertical frame attachment section is disposed along the inner surface of the vertical frame facing inward in a state of being disposed to make up a frame shape;

a brace attachment section, connected to the vertical frame attachment section, which enables attachment of an end of the brace at a position inward of the vertical frame attachment section; and a fixing plate, welded to the vertical frame attachment section, which can be fixed to the beam member or the foundation in a state where the fixing plate is disposed along an outer surface of the lateral frame facing outward in a state of being disposed to make up a frame shape, wherein each vertical frame has a vertical web, a pair of vertical flanges rising from both edges of the vertical web, a pair of vertical lips extending from the pair of vertical flanges in a direction of coming close to each other, and a pair of vertical cutout sections resulting from cutting out the pair of vertical lips over a predetermined vertical area from an end of the vertical frame;

the vertical frame attachment section can be attached to an inner surface of the vertical web, by way of a threaded member, in a state where the vertical frame attachment section is disposed along the inner surface of the vertical web facing inward in a state of being disposed to make up a frame shape;

the connecting fitting further comprises a pair of extension sections, extending parallelly along the pair of vertical flanges from both edges of the vertical frame attachment section, which are led out inward from the vertical frame through the pair of vertical cutout sections; and the brace attachment section is welded to the pair of extension sections in a state where the brace attachment section is disposed so as to straddle across the pair of extension sections, such that the brace attachment section enables attachment of an end of the brace at a position inward of the vertical frame attachment section.

10. The connecting fitting according to claim 9, wherein each lateral frame has a lateral web, a pair of lateral flanges rising inward from both edges of the lateral web, a pair of lateral lips extending from the pair of lateral flanges in a direction of coming close to each other, a first lateral cutout section resulting from cutting out the lateral web over a predetermined lateral area from an end of the lateral frame, and a pair of second lateral cutout sections resulting from cutting out the pair of lateral lips over the predetermined lateral area, and has a cross-sectional shape, identical to the cross-sectional shape of the vertical frame over an area outside the predetermined vertical area, over an area outside the predetermined lateral area; and the pair of extension sections that can be attached, by way of threaded members, to the pair of lateral flanges that are positioned within the predetermined lateral area and are disposed so as to sandwich the pair of extension sections.

11. The connecting fitting according to claim 9, wherein the fixing plate has an contact surface that can contact an entire end face of the vertical web that is attached to the vertical frame attachment section.

12. The connecting fitting according to claim 9, wherein the vertical frame attachment section and the pair of extension sections are configured integrally.

13. The connecting fitting according to claim 9, wherein the pair of extension sections is welded to the fixing plate.

14. A bearing wall that is fixed to at least one of a foundation and a beam member of a building, the bearing wall comprising:

a pair of vertical frames and a pair of lateral frames disposed to make up a frame shape;

four connecting fittings capable of connecting end sections of the vertical frames and end sections of the lateral frames; and two braces each provided between two connecting fittings which are disposed in a diagonal of the frame shape among the four connecting fittings, the braces supporting forces generated in the vertical frames and the lateral frames, wherein the four connecting fittings are the connecting fitting according to claim 9.

15. A building, comprising:

a foundation;

a beam member; and the bearing wall according to claim 14, fixed to at least one of the foundation and the beam member.

* * * * *